United States Patent [19]

Guiraldenq et al.

[11] 4,045,596

[45] Aug. 30, 1977

[54] SUPERFICIAL TREATMENT OF STEEL

[75] Inventors: Pierre Guiraldenq; Daniel Tréheux; Daniel Marchive, all of Ecully, France

[73] Assignee: Agence Nationale de Valorisation de la Recherche (ANVAR), Neuilly-sur-Seine, France

[21] Appl. No.: 692,415

[22] Filed: June 3, 1976

[30] Foreign Application Priority Data

June 12, 1975 France ..... 75.19016

[51] Int. Cl.[2] ..... C23C 9/00

[52] U.S. Cl. ..... 427/229; 427/376 H; 427/383 D

[58] Field of Search ..... 427/229, 376 H, 383 D

[56] References Cited

U.S. PATENT DOCUMENTS

| | | | |
|---|---|---|---|
| 1,655,269 | 1/1928 | Howe | 427/229 |
| 2,408,515 | 10/1946 | Hopkins | 427/376 H X |
| 3,041,206 | 6/1962 | Long et al. | 427/383 D |
| 3,316,625 | 5/1967 | Flint et al. | 427/376 H X |
| 3,573,963 | 4/1971 | Maxwell | 427/376 H X |
| 3,720,537 | 3/1973 | Rigney | 427/229 |
| 3,884,729 | 5/1975 | Jackson et al. | 427/376 H X |

FOREIGN PATENT DOCUMENTS

| | | | |
|---|---|---|---|
| 6,788,311 | 9/1966 | Belgium | 427/383 D |
| 645,990 | 7/1928 | France | 427/229 |

*Primary Examiner*—Ralph S. Kendall
*Attorney, Agent, or Firm*—Dowell & Dowell

[57] ABSTRACT

A steel part, and more particularly a stainless steel part, is coated with a varnish containing particles of an additional metal such as tin or aluminium, and it is heated at a temperature situated above the melting point of the said additional metal, but outside a zone comprised between 700° C and 970° C. The treated part may be annealed at about 500° C. The varnish may besides contain particles of a substance having a melting point situated above the melting point of the additional metal, but which may dissolve in the liquid phase of the latter. This substance may be chromium, molybdenum, cobalt, titanium, vanadium, nickel or copper.

5 Claims, 8 Drawing Figures

SUPERFICIAL TREATMENT OF STEEL

BACKGROUND OF THE INVENTION

The present invention relates to the superficial treatment of steel in order to increase its resistance against corrosion or to improve its properties concerning frictional effects.

It has been proposed to coat a steel article with an organic varnish containing an appropriate powdered additional metal, such as tin or aluminium, and then to heat the surface to destroy the varnish and to cause the powder particles to migrate into the steel where they realize a layer of complex compounds which protects the underlying metal against corrosion. But these methods have not given very satisfactory results. Moreover the steel parts thus treated afford quite poor frictional properties.

SUMMARY OF THE INVENTION

It is an object of the present invention to provide a method for the superficial treatment of steel parts, which permits of obtaining an improved protection against corrosion and also excellent frictional characteristics.

In accordance with this invention the steel parts to be treated are coated with an organic varnish containing particles of an appropriate additional metal, such as tin or aluminium, the melting point of which is below the thermal treatment temperature of the steel, and they are heated in a non oxidizing atmosphere at a temperature at least equal to the melting point of the particles, but outside the range 700° C – 970° C, eliminate the varnish and to cause the particles to combine with the steel, and to form thereon an intermediate layer of ferrites and an outer layer of compounds of iron and of the additional metal, the said outer layer being substantially continuous and firmly bound to the intermediate layer.

According to another feature of the present invention, the coated steel part is treated at a higher temperature and is thereafter annealed at about 500° C. This procedure permits of obtaining with a relatively short heating time, steel parts which exhibit still improved frictional properties.

Still according to another feature of this invention, the varnish further contains particles of a substance which is less fusible than the additional metal, but which is soluble in the liquid phase thereof. This substance may be a metal such as chromium, molybdenum, cobalt, titanium, vanadium, nickel or copper.

DETAILED DESCRIPTION OF THE INVENTION

In the following examples, the steel to be treated was a stainless steel of the type 18-10 (18% Cr, 10% Ni). The additional metal was tin under finely divided form (average diameter of the particles 10μ). The organic varnish was made of nitrocellulose. The tin particles were uniformly dispersed in this varnish by prolonged stirring. The suspension obtained was applied onto the parts by means of a brush. The coating was dried in open air at a relatively moderate temperature to obtain a uniform and smooth layer of dried varnish in which the metallic particles were embedded.

The heating step was effected in an atmosphere formed of argon gas.

The friction tests were performed on a Faville machine, the sample to be tested being the rotating member, while the stationary member was made of quenched and annealed steel. The rotational speed was 88 r.p.m. and the load applied 14 kg.

The corrosion tests were effected by alternatively plunging the sample into sea water at ambient temperature for 30 minutes and withdrawing it therefrom and leaving it in open air for another 30 mn.

EXAMPLE I

This example was a reference test effected on a bare untreated steel sample.

Figure 1:
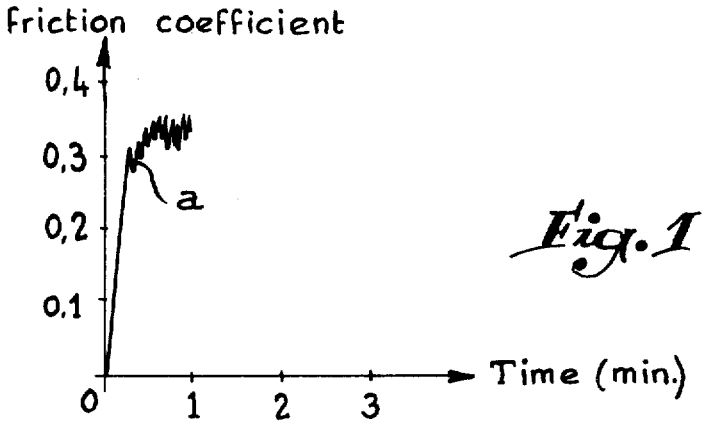
FIG. 1 is a graphic representation of the results of the friction test effected on an untreated sample.

FIG. 1 illustrates the curve corresponding to the friction test. As shown the friction coefficient rose quite rapidly during the first seconds and seizing phenomena appeared (point *a*). The sliding surface were quickly eroded.

In sea water specks and cracks were quite noticeable after some days.

EXAMPLE II

This example corresponds to a treatment performed below the unfavourable temperature range of 700° C–970° C.

The steel sample received a coating of the tin containing nitrocellulose varnish and after drying it was heated at about 650° C during 24 hours. It was thereafter progressively cooled at room temperature.

Figure 2:
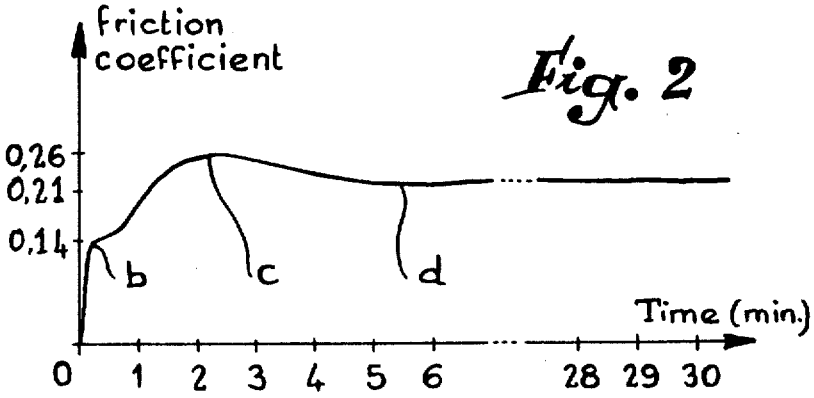
FIG. 2 illustrates the result of a friction test concerning a sample treated with tin at a relatively low temperature.

FIG. 2 shows the curve corresponding to the friction test performed on the treated sample. The friction coefficient rose rapidly during the first seconds (point*b*) and then more progressively up to a maximum of about 0.25 after 2 minutes (point *c*). It thereafter decreased to reach about 0.22 after 5 minutes (point *d*) and remain uniformly at that value during the remainder of the test. The latter was stopped after 30 minutes.

In the sea water test no noticeable corrosion was observed after 15 days.

Figure 3:
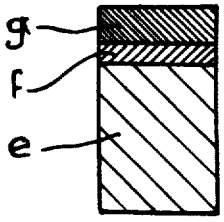
FIG. 3 shows a micrographic section of this sample.

FIG. 3 diagrammatically shows a section of the sample as it appeared micrographically. In this Figure, *e* is the underlying steel matrix, *f* designates a compact intermediate layer of ferrite and *g* an outer compact layer of an iron and tin compound corresponding to the formula FeSn.

The ferrite - layer *f* contained a very small percentage of tin and some Cr (about 20%). It was formed of cubic crystals. The crystals of the FeSn layer *g* were hexagonal. They contained about 2% Cr. Layers *f* and *g* appeared as compact, without any noticeable crack. They were firmly bound to each other and to the matrix *e*. The excellent results obtained were obviously due to the presence of the outer layer *g* and to the fact that this layer was compact and bound to the intermediate ferrite layer *f*.

EXAMPLE III

This example corresponds to a test effected within the range 700° C–970° C which is to avoided according to the present invention.

The procedure was as in Example II, but the heating temperature was 780° C with a heating time of 3 hours.

The sea water test demonstrated that the sample was less corrodible than the untreated sample of Example I, but that the improvement was insufficient for practical purposes.

Figure 4:
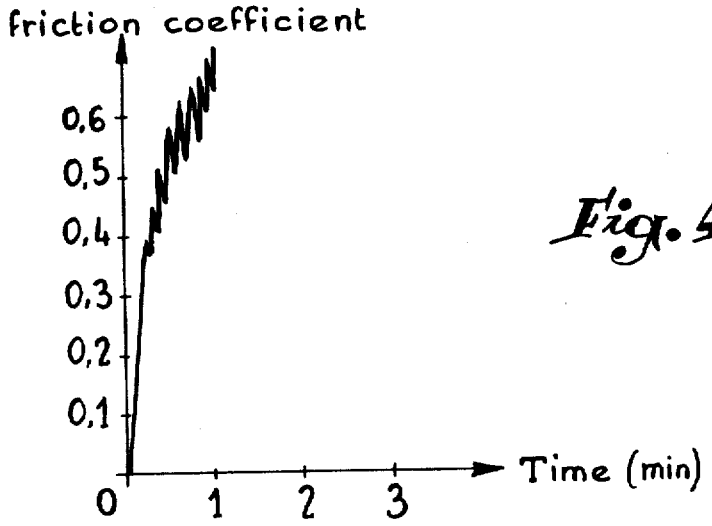
FIG. 4 corresponds to a friction test effected on a sample treated with tin in the temperature zone 700° C -970° C.

FIG. 4 shows the results of the friction test. The friction coefficient rose still more rapidly than in the case of untreated sample (see FIG. 1) and it went on increasing after the appearance of the seizing phenomena.

Figure 5:
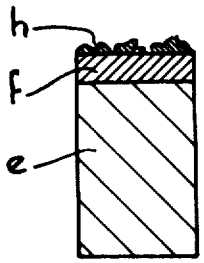
FIG. 5 is a micrographic section of the sample of FIG. 4.

FIG. 5 illustrates a micrographic section of the sample. Here again the underlying steel matrix is referenced *e*. It is covered with an intermediate ferrite layer *f*. The outer layer *h* was here discontinuous and quite irregular. It was in fact formed of the compound $Fe_3Sn_2$ of monoclinic crystalline structure. It was easily detachable from the intermediate layer, which explains the poor frictional results. Its numerous cracks allowed sea water to reach the intermediate ferrite layer which was not thick enough to afford a sufficient protection for the underlying steel matrix.

EXAMPLE IV

This example corresponds to a test effected at a temperature above the unfavourable range of 700° C–970° C which is to be avoided according to the present invention.

The varnished sample was heated at 1000° C for 1 hour and thereafter quenched in oil.

The results of the friction test were more or less similar to those of Example I. But the sea water test was excellent, no noticeable corrosion being detected after 2 months.

Figure 6:
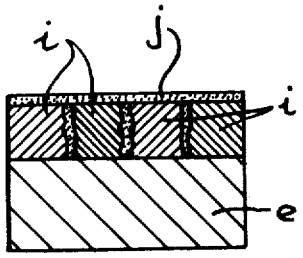
FIG. 6 illustrates the micrographic section of a sample treated with tin at a temperature above the aforesaid zone 700° C–970° C.

The micrography of the sample appeared as indicated in FIG. 6. The underlying steel matrix *e* was covered with an intermediate layer *i* formed of columns of ferrite separated by thin spaces filled with the iron-tin compound $Fe_5Sn_3$ of hexagonal crystalline structure similar to FeSn. This same compound formed a thin outer layer *j*. The thickness of the ferrite layer (35μ) explains the results of the sea-water test.

EXAMPLE V

A sample was prepared as indicated in Example IV. It was thereafter annealed at 500° C during 1 hour and quenched in water.

Figure 7:
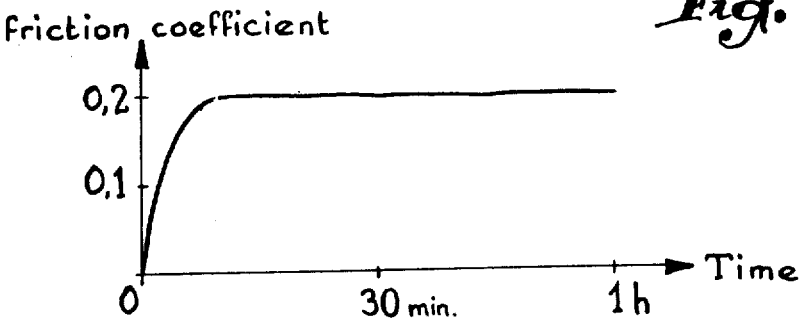
FIG. 7 shows the results of the friction test effected on a sample treated with tin above the range 700° C–970° C and thereafter submitted to an annealing operation.

The sea water test was as good as for the sample of Example IV, but the friction test was still better than for the sample of Example II. The corresponding curve is illustrated in FIG. 7. As shown the friction coefficient rose less rapidly than for the first sample. It only reached 0.20 without previously exceeding this value and it was substantially constant during the whole test which lasted more than 1 hour.

The micrography revealed that there had been formed on the intermediate ferrite layer a uniform and compact layer of FeSn firmly bound to the ferrite layer. The thickness of this outer layer was about 18 to 20μ.

Comparing Examples II and IV, it may be noted:

— that the sea water test is far better for Example V than for Example II;

— that the results of the friction test are slightly better (friction coefficient never exceeding 0.20, even at the beginning of the test).

— and that the time required for the treatment is far shorter for Example V (2 hours) than for Example II (24 hours).

EXAMPLE VI

This example refers to the use of aluminium as the additional metal.

The steel sample coated with a varnish containing particles of substantially pure aluminium was heated at 680° C for 2 hours and thereafter quenched in water.

Figure 8:
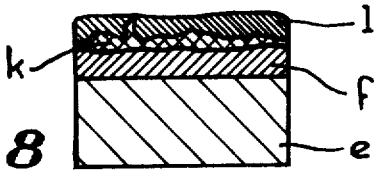
FIG. 8 is a micrographic section of a sample treated with aluminium after a sea water test.

FIG. 8 shows a micrographic section through a sample used to perform a friction test. The final friction coefficient was admittedly relatively high (about 0.41), but it reman stable and no seizing phenomena were noticeable.

The sea water test was not excellent, specks and cracks appearing after about 16 days (FIG. 8). Corrosion *k* was however limited to the outer layer *e* and did not affect the compact ferrite layer *f*.

A micrographic section revealed the presence of an intermediate ferrite layer and of an outer layer formed of orthorhombic $Fe_2Al_5$. Though firmly bound to the ferrite layer, this outer layer showed some discontinuities, which explains the relatively poor sea water test results.

EXAMPLE VII

The procedure was as in Example VI, but the varnish included a small percentage of molybdenum particles capable of dissolving in the liquid aluminium phase.

The result of the friction test was only slightly improved. But the sample was unattacked by sea water after 2 months.

Other tests have been made with a mixture of tin and aluminium particles in the proportion of 65% Al and 35% Sn. With such a mixture the outer layer is practically absent and therefore in the sea water test it plays no role whatever, the ferrite layer efficiently protecting the underlying steel matrix.

We claim:

1. A method for the treatment of steel surfaces to form thereon an intermediate layer of ferrites and an outer layer on tin-iron compound of the type FeSn to improve their resistance to corrosion and their frictional properties which consists essentially:

in coating the parts with an organic varnish containing finely divided tin particles:

and in heating the coated parts to a temperature at least equal to 650° C but situated outside the range 700° C–970° C to eliminate the varnish, and maintaining said temperature for a time sufficient to cause the particles to react with the underlying steel and to form thereon said intermediate layer of ferrites and said outer layer of tin-iron compounds, the said outer layer being substantially continuous and firmly bound to the intermediate layer.

2. In a method as claimed in claim 1, the further step of annealing the treated steel surfaces at about 500° C to improve the thickness and the compactness of the layers.

3. In a method as claimed in claim 1, said varnish including particles of a substance less fusible than tin, but capable of being dissolved in the liquid phase of the tin.

4. In a method as claimed in claim 3, said substance being a metal.

5. In a method as claimed in claim 1, said steel surfaces comprising stainless steel containing substantially 18% Cr and 10% Ni.

* * * * *